US009114862B2

(12) United States Patent
Dingel

(10) Patent No.: US 9,114,862 B2
(45) Date of Patent: Aug. 25, 2015

(54) STIFFENER FOR INFLATABLE DROP-STITCH STAND-UP PADDLE BOARD AND METHOD OF MANUFACTURING SAME

(71) Applicant: Bryan Dingel, Boise, ID (US)

(72) Inventor: Bryan Dingel, Boise, ID (US)

(73) Assignee: Northwest River Supplies, Inc., Moscow, ID (US)

( * ) Notice: Subject to any disclaimer, the term of this patent is extended or adjusted under 35 U.S.C. 154(b) by 0 days.

(21) Appl. No.: 14/297,466

(22) Filed: Jun. 5, 2014

(65) Prior Publication Data

US 2014/0364022 A1 Dec. 11, 2014

Related U.S. Application Data

(60) Provisional application No. 61/832,071, filed on Jun. 6, 2013.

(51) Int. Cl.
*B63B 35/79* (2006.01)

(52) U.S. Cl.
CPC ..... *B63B 35/7913* (2013.01)

(58) Field of Classification Search
CPC ..... B63B 35/7913
USPC ..... 441/66
See application file for complete search history.

(56) References Cited

U.S. PATENT DOCUMENTS

| | | | | |
|---|---|---|---|---|
| 4,462,331 | A * | 7/1984 | McCrory | 114/345 |
| 6,066,016 | A * | 5/2000 | Yonover | 235/379 |
| 8,591,274 | B2 * | 11/2013 | Haller et al. | 441/66 |
| 8,821,204 | B1 * | 9/2014 | Hoge, Jr. | 441/66 |
| 8,834,220 | B2 * | 9/2014 | Haller et al. | 441/74 |
| 8,882,554 | B2 * | 11/2014 | McKinney | 441/74 |
| 2003/0153221 | A1 * | 8/2003 | Weir | 441/66 |
| 2013/0137319 | A1 * | 5/2013 | Haller et al. | 441/66 |
| 2014/0080369 | A1 * | 3/2014 | Haller et al. | 441/66 |
| 2014/0242860 | A1 * | 8/2014 | Hoge, Jr. | 441/66 |
| 2014/0364022 | A1 * | 12/2014 | Dingel | 441/66 |

* cited by examiner

*Primary Examiner* — Lars A Olson
*Assistant Examiner* — Jovon Hayes
(74) *Attorney, Agent, or Firm* — Duncan Palmatier

(57) ABSTRACT

An inflatable board, which can be used for floating or paddling on water, with a thin layer of inelastic material, such as acrylic, bonded between the layers of material forming the top or bottom surfaces of an inflatable board. The thin layer of inelastic material is bonded between the inner material and the outer material. The thin layer of inelastic material is bendable, so that the un-inflated board may be rolled-up for storage or transportation. When inflated, the thin layer of inelastic material bonded between the layers of the top or bottom surfaces of the board increases the rigidity of the board and the board's ability to resist flexing and bending.

12 Claims, 4 Drawing Sheets

STIFFENER FOR INFLATABLE DROP-STITCH STAND-UP PADDLE BOARD AND METHOD OF MANUFACTURING SAME

CLAIM OF PRIORITY TO PROVISIONAL APPLICATION (35 U.S.C. §119(e))

This application claims priority under 35 U.S.C. §119(e) from provisional patent Application No. 61/832,071, filed Jun. 6, 2013. The 61/832,071 Application is incorporated herein by reference.

BACKGROUND OF THE INVENTION

1. Field of the Invention

This invention relates to a stiffener for an inflatable water recreation board, such as an inflatable "Stand Up Paddle" ("SUP") board, especially for such a board constructed of drop-stitch material.

2. Background

Inflatable SUP boards are most often used for recreational purposes, such as paddling and catching waves in the ocean and paddling and riding rapids in rivers. Inflatable SUP boards, and inflatable water sports boards in general, are useful, because they are more easily transported than traditional, rigid boards made of fiberglass or hard plastics, insofar as an inflatable board can be deflated, rolled up, and put in a car trunk or even carried by a hiker, whereas traditional boards must be carried on a car's roof rack or schlepped under a surfer's arm or the surfer's head. This advantage has long been recognized in the art, for example in U.S. Pat. No. 2,018,548 to William T. Currey, issued in 1935, for an inflatable "Surf Board", where one of the problems the invention was intended to solve was that the prior art boards could not "be readily collapsed to occupy small space for transportation." Id., at col. 1, lines 22-24, and at col. 1, lines 38-40 (the invention could "be collapsed or inflated as desired, the device when collapsed occupying a relatively small space"). Another long-recognized disadvantage of traditional rigid boards is that, owing to their rigidity, they can injure the user or other nearby persons if the board hits them. See, e.g., U.S. Pat. No. 1,206,696 to Gulbrandsen, issued in 1916, for a "Surf Coaster", at col. 1, lines 19-22. Inflatable boards, which are made of air-tight, rubbery materials, are less likely to cause injury to persons hit by them. Yet another disadvantage of rigid boards, especially when used in riding river rapids, is that they are easily damaged and dinged when they strike a rock. Inflatable boards can absorb and withstand these impacts, usually without any damage.

However, inflatable surfboards have always had a nagging defect, in that they are not rigid and, as a result, tend to bend and distort when used. This defect makes inflatable boards much less desirable, especially when they are used for riding waves or rapids. Various attempts at overcoming this problem have been proposed. For example, U.S. Pat. No. 3,657,753 to Le Blanc., Sr., issued in 1972, for a "Folding Inflatable Surfboard", disclosed an inflatable surfboard that resisted longitudinal bowing by use of a flexible, but substantially non-elastic, convex panel placed over the top surface of the un-inflated board. Id., Abstract. When the board is inflated, the panel is held in a bowed condition, which secures the panel and prevents the board from flexing. Id.

In the years following World War II, efforts were made to develop an inflatable material with increased rigidity and from this work "drop-stitch" construction was created. See, e.g., U.S. Pat. No. 2,753,573 to Barker, issued in 1951, for an "Inflatable Mattress", U.S., Pat. No. 4,251,573 to McCrory et al., issued in 1981, for "Inflatable Boat For High Speed Use". This use of drop-stitch construction was adapted to inflatable rescue boards (see e.g., U.S. Pat. No. 3,775,782 to Rice et al., issued in 1973, for an "Inflatable Aquatic Rescue Board And Method Of Rescue"), and has in recent years found success in inflatable SUP boards. Yet, while drop-stitch construction substantially increases an inflatable board's rigidity when compared to earlier inflatable water craft, the problem has not been fully solved and the flexing problem persists.

What is needed is an inflatable board that overcomes the problem of flexing. More particularly, needed is an inflatable board of drop-stitch construction, which retains the advantages of being easily transported and posing less risk of injury to the user or others, yet provides increased rigidity and a resistance to bowing and flexing.

SUMMARY OF THE INVENTION

The present invention is an inflatable board, which can be used for floating or paddling on water, with a thin layer of inelastic material, such as acrylic, bonded between the layers of material forming the top or bottom surfaces of an inflatable board. For example, in an inflatable SUP board employing drop-stitch construction, the thin layer of inelastic material is bonded between the inner, fabric material and the outer, PVC material. The thin layer of inelastic material is bendable to a degree, so that the un-inflated board may be rolled-up for storage or transportation. When inflated, the drop-stitch construction forms a hard, flat board. The thin layer of inelastic material bonded between the layers of the top or bottom surfaces of the board increases the rigidity of the board and the board's ability to resist flexing and bending.

DETAILED DESCRIPTION OF THE PREFERRED EMBODIMENTS

Figure 1:
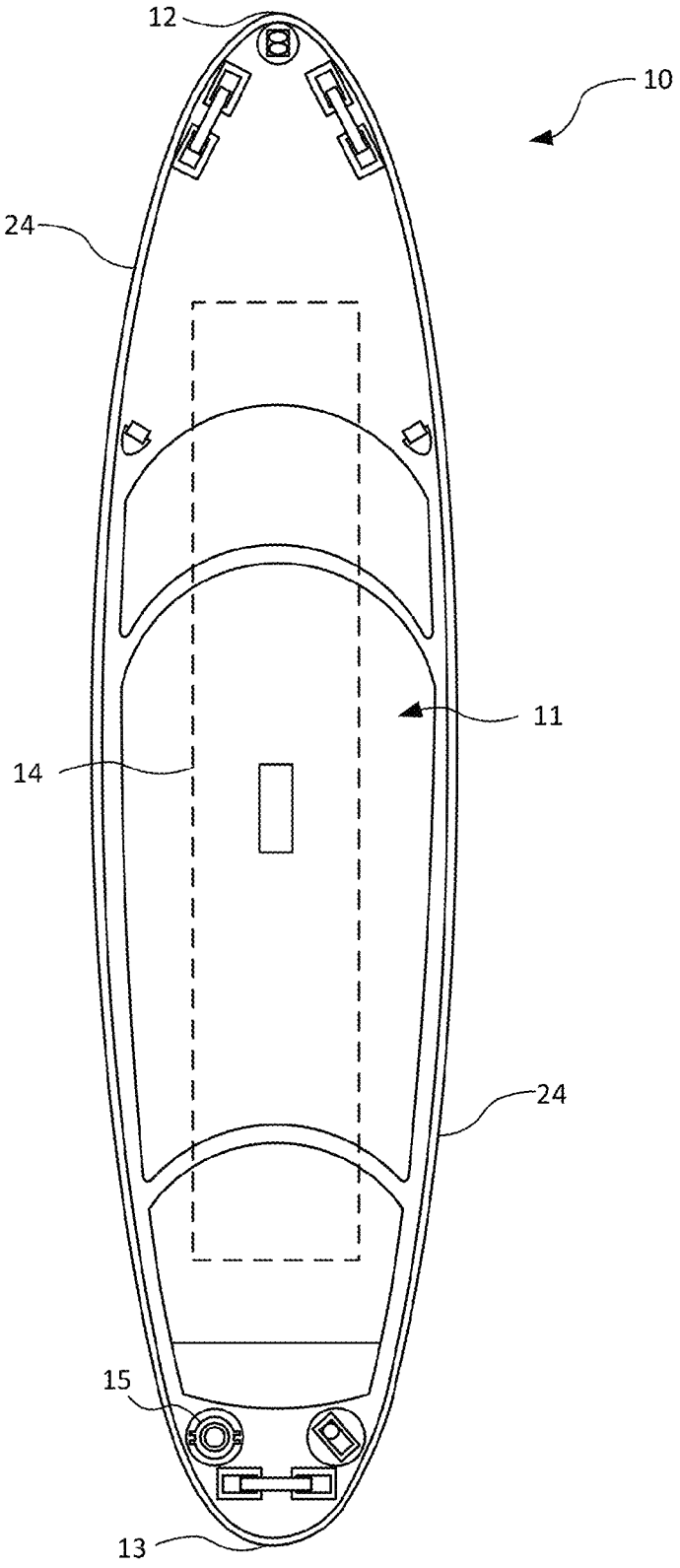
FIG. 1 is a top view of an inflatable stand-up paddleboard with a stiffener incorporated into the top layer.
Figure 4:
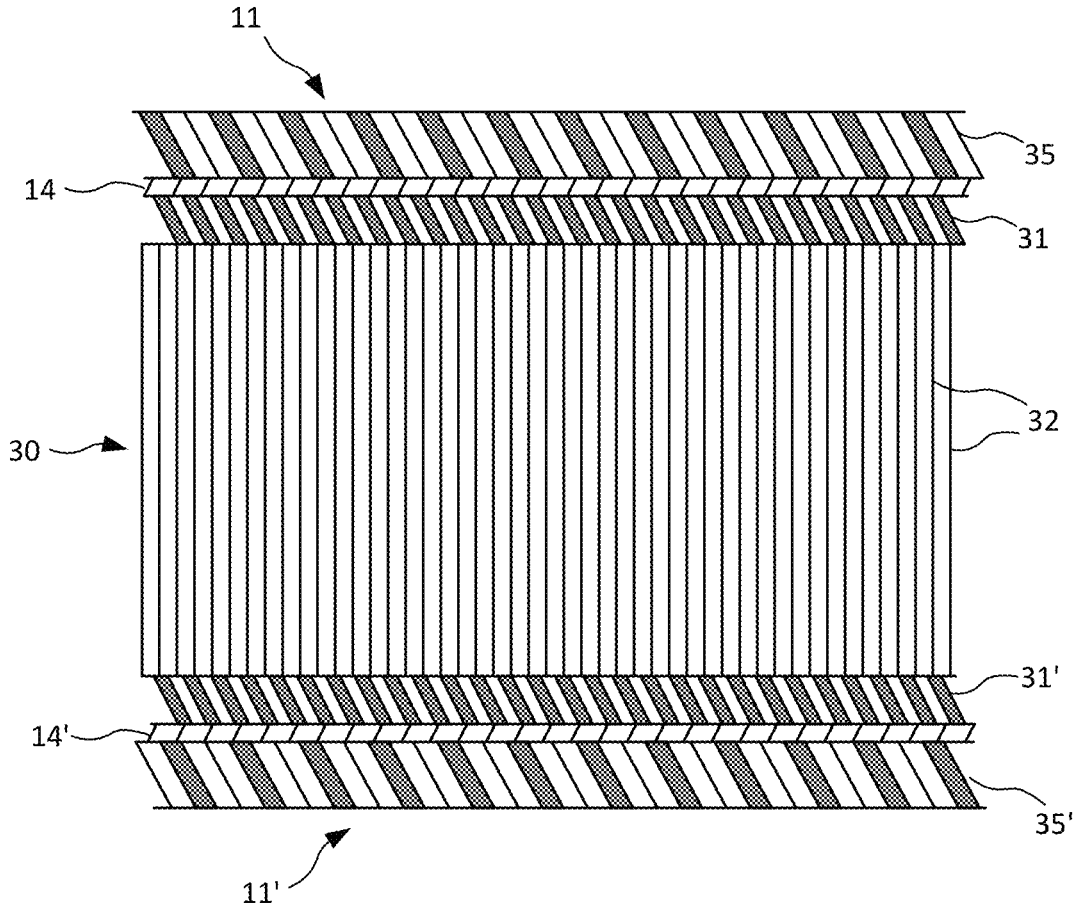
FIG. 4 is a side view of a cross-section of the drop-stitch construction of an inflatable drop-stitch stand-up paddleboard, showing stiffening film layers incorporated into the top and bottom surfaces.

FIG. 1 shows a top view of an inflatable SUP board 10, indicating the front 12, rear 13, and top surface 11 of the board 10, as well as the inflation valve 15, near the rear 13. As seen in FIG. 4, the inelastic stiffening film layer 14 in the top surface 11 of the board 10 is sandwiched between the top substrate 31 of the drop-stitch core 30 and the outer PVC layer 35. The drop-stitch threads 32 are interwoven with a base cloth layer incorporated into substrate 31. One side of the top stiffening film 14 is bonded to the top drop-stitch substrate 31, and the other side of the top stiffening film 14 is bonded to the top PVC layer 35. Referring again to FIG. 1, the inelastic stiffening film layer 14 occupies a portion of the central part of the top surface 11 of the elongated board 10, but the inelastic stiffening film layer 14 can occupy a larger or smaller area.

Figure 2:
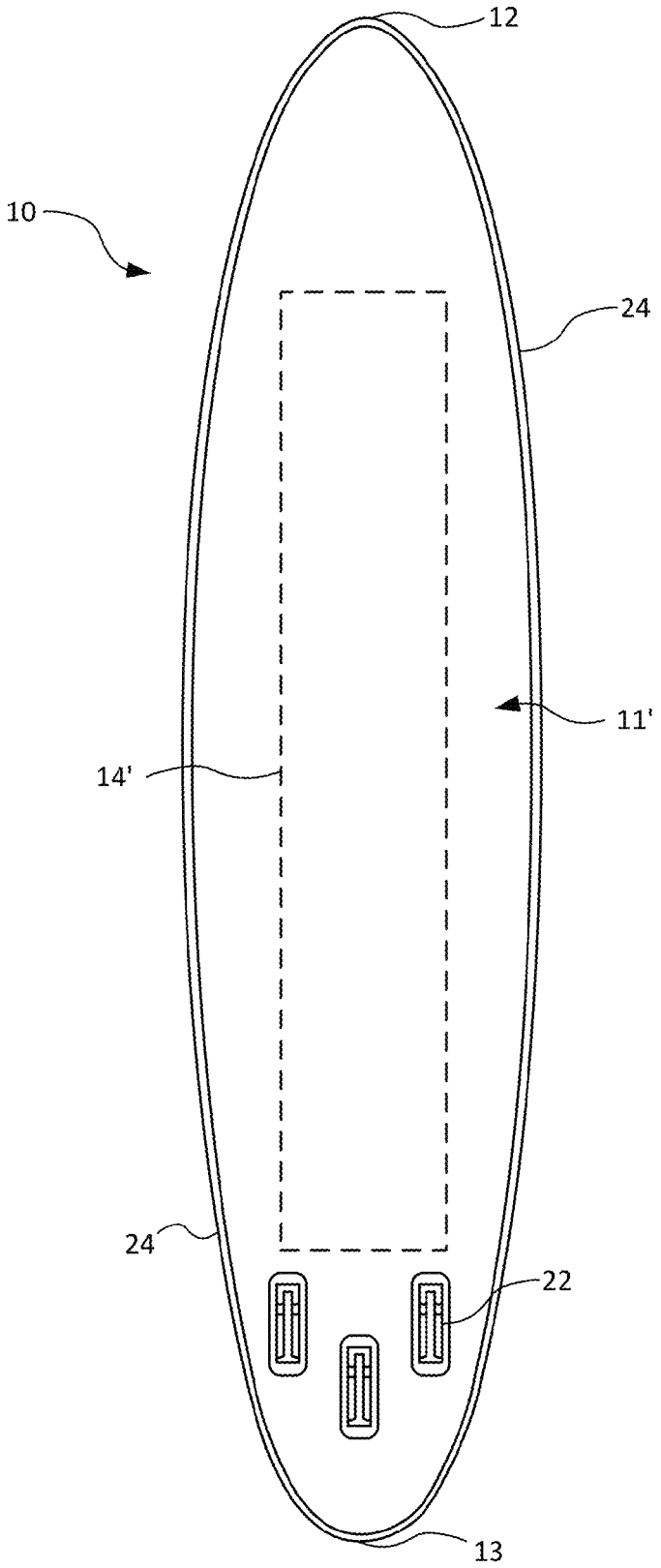
FIG. 2 is a bottom view of the inflatable stand-up paddleboard with a stiffener incorporated into the bottom layer.
Figure 3:
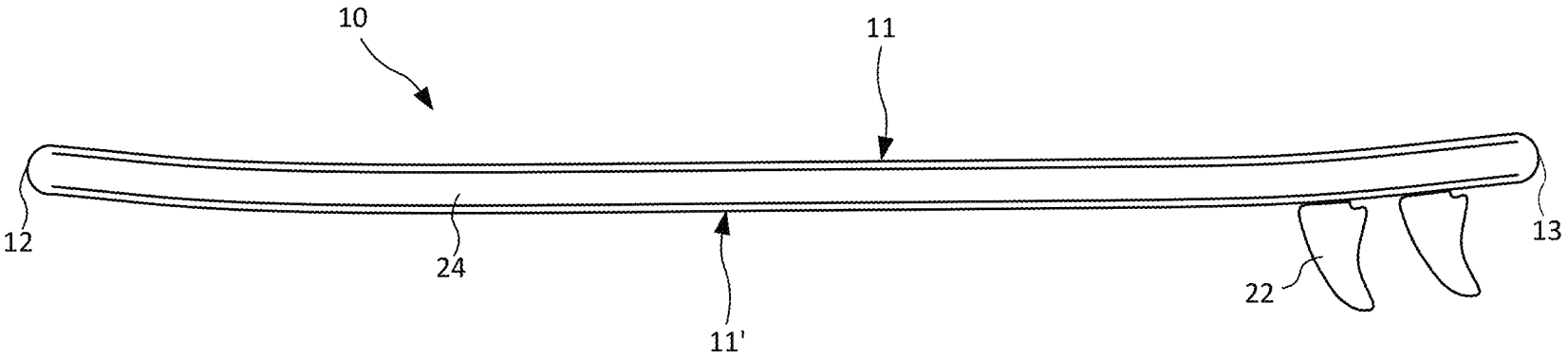
FIG. 3 is a side view of an inflatable stand-up paddleboard.

FIG. 2 shows a bottom view of the inflatable SUP board 10, indicating the front 12, rear 13, and bottom surface 11' of the board 10, as well as the skegs 22, near the rear 13. Referring again to FIG. 4, as with the upper stiffening film 14, the bottom stiffening film 14' is bonded between the drop-stitch bottom substrate 31' of the drop-stitch core 30 and the outer PVC layer 35'. The drop-stitch threads 32 are interwoven with a base cloth layer incorporated into bottom substrate 31'. One side of the bottom stiffening film 14' is bonded to the bottom drop-stitch substrate 31', and the other side of the bottom stiffening film 14' is bonded to the bottom PVC layer 35'. As with the top surface stiffening film 14, the bottom stiffening film 14' can occupy substantially all or only a portion of the bottom surface 11'

It has been found that, for an average sized inflatable SUP board that is about 10 feet long by 30 inches wide by 4 inches thick, top and bottom stiffening films (14 and 14') of about 6.5 feet long by 12 inches wide by 188 micrometers (0.188 mm) thick are effective in increasing stiffness up to 20% over the same board without the stiffening films. Increasing the thickness of the stiffening films can further increase stiffness, but at the expense of increased inflexibility in the deflated state. Thinner stiffening films make the board easier to roll-up for storage, but the stiffening effect drops off quickly. Increasing the portion of the area of the top or bottom surfaces (11 and 11') covered by the stiffening films (14 and 14') adds some incremental stiffness. The dimensions of the average sized inflatable SUP board (about 10×2.5 feet) and stiffening film 14 (6.5×1 feet), stated above, results in a top or bottom stiffening film (14 or 14') that occupies about 30% of the central surface area of the top or bottom surface (11 or 11') of the board 10. Increasing the area of the surface (11 or 11') covered by the stiffening film (14 or 14') will provide some incremental stiffness, but as the inelastic stiffening films (14 and 14') reach the rails 24 of the board 10, undesired creasing of the inelastic film 14 material may occur where the flat surface of the drop-stitch material meets the curving area at the rails 24. Because the stiffening film is inelastic, as discussed below, it will resist stretching and bending to conform to complex contours, thereby degrading the integrity of the layers in the inflatable board. Reducing the area of the portions of the top or bottom surfaces (11 or 11') covered by the stiffening films (14 or 14') decreases the stiffness and this decreased stiffness drops quickly as less surface area is covered. It is possible to increase the stiffness of an inflatable drop-stitch board by using a stiffening film (14 or 14') in only one of the top or bottom surfaces (11 or 11') of a board 10, but it has been found that the effectiveness is greatest when used in both top 11 and bottom 11' surfaces.

Drop-Stitch material 30 allows structures to be inflated to high pressures by joining the surfaces by tens of thousands of fine threads 32. The process starts by joining two pieces of polyester woven support fabric (31 and 31') with thousands of fine polyester thread lengths 32. This base material (31 and 31') is made in strips from five to ten feet in width, and up to 400 needle heads may be used in the manufacture. Each needle sews a continuous, evenly spaced thread 32, back and forth between the two pieces of woven fabric base material (31 and 31'). Polyester thread is used throughout because it is strong, durable and has very little stretch. The polyester threads 32 are substantially inelastic and the thousands of threads 32 lock the base substrates (31 and 31') together to form an exceptionally strong unit. In conventional drop-stitch construction, air-tight PVC coating layers (35 and 35') are applied to the outer surfaces of both base substrates (31 and 31'). In the present invention, a stiffening film layer (14 or 14') is disposed between at least one of the top or bottom drop-stitch base substrates (31 or 31') and the outer layers (35 or 35'), by bonding the stiffening film (14 or 14') to the base substrate (31 or 31') and bonding the outer layer (35 or 35') to the stiffening film (14 or 14'). Sidewall material (not shown), usually made of a polyester base fabric with a non-breathable coating on both sides, is then glued between the top and bottom surfaces (35 and 35') to form the edges, or rails, 24 of the board 10 and create an airtight drop-stitch core 30. This construction can be inflated to pressures up to 15 pounds per square inch (psi). The inelastic stiffening films (14 and 14') are supported by the rigid drop-stitch core 30 and provide reinforcement against flexing, thereby decreasing the tendency of the inflatable board to deform or bend. This construction makes the inflatable board 10 more like the rigid fiberglass or hard plastic boards, although the resulting board is still less likely to cause injury to the user or persons nearby, because the outer PVC construction is still relatively soft and the rails 24, which are the part most likely to strike someone, remain soft. Yet, when deflated, the stiffening films (14 and 14') can be bent enough such that the board 10 can rolled-up for storage.

The stiffening films (14 and 14') of the present invention are, preferably, made of an inelastic material that allows little stretching or bending, such as acrylic. When supported by an inflated drop-stitch core 30, an acrylic stiffening film layer (14 and 14') provides significant added stiffness when a user is standing on the top 11 of the board 10. Tests of the present invention have shown that an inflatable drop-stitch SUP board 10 with acrylic stiffening film layers (14 and 14') will have up to 20% more resistance to bending in response to pressure exerted against the center of the board 10, where a SUP rider stands, as compared to the same board without the stiffening films (14 and 14').

While the inflatable water board stiffener of the present invention has been described as being applied to a drop-stitch SUP board, it will be obvious to a person skilled in the art that it may also be applied in other situations where a corresponding stiffening need exists.

I claim:

1. An inflatable board capable of floating in water, comprising:

a drop-stitch core having a top substrate with an inner top substrate surface and an outer top substrate surface, and a bottom substrate with an inner bottom substrate surface and an outer bottom substrate surface, the inner top substrate surface joined to the inner bottom substrate surface by a plurality of threads, wherein the top substrate surface forms a substantially planar top surface held by the plurality of threads at a fixed distance from the bottom substrate surface which forms a substantially planar bottom surface when the board is inflated, wherein the core has a length and a width, wherein the core length is longer than the core width, and wherein the top substrate surface has a top substrate periphery and the bottom substrate surface has a bottom substrate periphery, an edge material joining the top and bottom substrate peripheries to form a rail, wherein the rail forms a top rail curve at the top substrate periphery and a bottom rail curve at the bottom substrate periphery, and a stiffening layer, formed of an inelastic film, disposed over at least one of the substantially planar top surface or substantially planar bottom surface, wherein the stiffening layer has a layer length smaller than the core length and a layer width smaller than the core width, wherein the layer length and width form a layer periphery, and wherein the layer periphery does not extend beyond the substantially planar top or bottom surfaces to the top or bottom rail curves.

2. The inflatable board of claim 1, further comprising an airtight material disposed over the outer top and bottom substrate surfaces.

3. The inflatable board of claim 2, wherein the airtight material is further disposed over the edge material.

4. The inflatable board of claim 2, wherein the edge material is airtight.

5. The inflatable board of claim 2, wherein the stiffening layer is disposed between the outer top or bottom substrate surfaces and the airtight material.

6. The inflatable board of claim 2, wherein the stiffening layer is disposed over the airtight material.

7. The inflatable board of claim 1, wherein the core length and width define a core area, wherein the layer length and width define a layer area, and wherein the layer area is not more than 40 percent of the core area.

8. The inflatable board of claim 7, wherein the layer area is between 25 percent and 35 percent of the core area.

9. The inflatable board of claim 1, wherein the stiffening layer has a thickness and said thickness is not more than 0.250 mm.

10. The inflatable board of claim 9, wherein the stiffening layer thickness is between 0.200 mm and 0.150 mm.

11. The inflatable board of claim 1, wherein the inelastic film is acrylic.

12. The inflatable board of claim 1, wherein the stiffening layer is disposed over both of the substantially planar top surface and the substantially planar bottom surface.

* * * * *